United States Patent [19]

Burr

[11] Patent Number: 4,560,356

[45] Date of Patent: Dec. 24, 1985

[54] PERSONAL FLOTATION DEVICE

[75] Inventor: J. Kelsey Burr, Jupiter, Fla.

[73] Assignee: Halkey-Roberts Corporation, St. Petersburg, Fla.

[21] Appl. No.: 514,442

[22] Filed: Jul. 18, 1983

Related U.S. Application Data

[63] Continuation-in-part of Ser. No. 462,213, Jan. 31, 1983, Pat. No. 4,498,879.

[51] Int. Cl.[4] ..... B63C 9/22

[52] U.S. Cl. ..... 441/80; 222/5; 441/88; 441/94

[58] Field of Search ..... 441/92-95, 441/80, 88, 42; 222/5

[56] References Cited

U.S. PATENT DOCUMENTS

| | | | |
|---|---|---|---|
| 3,448,471 | 6/1969 | Oldham | 441/42 |
| 3,449,777 | 6/1969 | Hattori | 441/94 |
| 3,716,882 | 2/1973 | Middleton, Jr. et al. | 441/95 |
| 4,031,583 | 6/1977 | Phillips, II | 441/80 X |

FOREIGN PATENT DOCUMENTS

| | | | |
|---|---|---|---|
| 653773 | 12/1962 | Canada | 441/92 |

*Primary Examiner*—Sherman D. Basinger
*Attorney, Agent, or Firm*—Stein & Reese

[57] ABSTRACT

A person emergency rescue assembly comprising a container attachable to a person with an automatically inflatable flotation device stored in the container. The container is readily opened by pulling on a release so that the flotation device automatically inflates.

4 Claims, 19 Drawing Figures

PERSONAL FLOTATION DEVICE

PRIOR APPLICATION

This is a continuation-in-part of my prior co-pending application Ser. No. 462,213, filed Jan. 31, 1983, now U.S. Pat. No. 4,498,879.

BACKGROUND OF INVENTION

This invention relates to emergency devices to assist in the rescue of persons who have fallen overboard in deep water. In particular, it relates to flotation devices which can be sent into the water immediately after the emergency is discovered or worn by individuals.

Prior art emergency devices have one or more disadvantages such as time consuming deployment and excessive weight. Personal flotation devices which have been described in the prior art are typically bulky, hot and uncomfortable to wear.

One object of the present invention is to provide a compact, lightweight flotation device which can be worn by the person and readily and reliably deployed.

Other objects and advantages of this invention will be apparent from the description and claims which follow, taken together with the appended drawings.

SUMMARY OF INVENTION

The invention comprises broadly an assembly of an inflatable flotation device in a container mounted on the deck of a ship or worn by the individual. The ship-mounted container has a front flap which is releasably secured to the walls of the container. A pull on a strap attached to the flap opens the container and permits the stored device to fall into the water. Means are provided to automatically inflate the devices with a gas under pressure, as for example, carbon dioxide.

The device worn by the individual person also has a front flap which is releasably secured to the walls of the container. A pull on the flap device by the person in the water opens the container and initiates the inflation of the stored flotation device. As the pressure and volume build up in the flotation device the device is forced out from the open container into the water. Adjustable snaps are provided to secure the flotation device to the person in a suitable position, the device at all times being tethered to the person.

In its preferred form, the ship-mounted container holds both inflatable location and inflatable flotation devices tethered together. In addition, it is preferred that identification and signal devices be included, as for example, a strobe light, air horn, whistle, flares, dye marker, distress flag, radar reflector panels, helium balloon and sea anchor. Where appropriate such identification and signal devices may also be tethered to the inflatable devices.

In one particular form, the ship-mounted container is attached by straps to the rail on the deck of a ship. A release strap extends from the bottom of the front flap to the top of the container where it is connected to a line attached to the deck. Thus, a pull on the line immediately pulls up the front flap permitting the stored devices to fall into the water. The front panel is preferably releasably attached, as for example, with the fastener sold under the trademark "Velcro" to an upward skirt extension of the bottom panel. When the front flap is pulled up, the skirt and bottom panel drop down. A metal snap between the front panel and the skirt insures that the container will not open accidentally but only when there is sufficient pull.

The inflatable location device of the ship-mounted container is preferably a signal cone with a weight in the bottom to keep it vertical when inflated. Inflation of the devices is accomplished by releasing gas stored under pressure. Such release is accomplished either by the action of the water on the release mechanism or by mechanical release triggered by the pull on lines attached to the container as the contents fall into the water. In the latter instance, for example, a spring-loaded puncture pin is driven into the opening of the vessel under pressure, thus permitting inflation. The driving is accomplished by a pivoted arm, one end of which is connected to the container. As the devices fall, the pull causes the arm to pivot and then fall away. The inflation thus starts before the devices hit the water. Water-soluble releases can also be used since they are activated immediately upon striking the water.

In the personal flotation device, a metal snap is also preferred to prevent accidental opening of the container.

BRIEF DESCRIPTION OF DRAWINGS

FIGS. 1–11 illustrate a ship-mounted container, while

FIG. 1 is a view showing the container with stored flotation devices mounted on the rail of a boat and with its release line attached to the deck.

FIG. 2 shows the same view as FIG. 1 after the devices have been dropped from the container.

FIG. 3 shows the devices partially inflated on the surface of the water.

FIG. 4 shows the devices fully inflated with the survivor in position on the horseshoe.

FIG. 5 is a partial perspective view of a preferred form of the invention in stowed condition mounted on the rail of a boat with its release line attached to the deck.

FIG. 6 is an opposite perspective view of FIG. 5 showing the attachment of the front panel to the skirt extension of the bottom panel.

FIG. 7 is a schematic cross-section along line 7—7 of FIG. 6 showing the packing of the inflatable devices in the container.

FIG. 8 is an enlarged detailed view of the fully-inflated, tethered devices in the water.

FIG. 9 is a partial section along line 9—9 showing the bottom portion of the signal cone.

FIG. 10 is a schematic section showing the operation of the water soluble release mechanism for inflating with gas under pressure.

FIG. 11 is a schematic section showing the mechanism for mechanically releasing the gas under pressure.

FIG. 12 is a front perspective view of another embodiment of this invention; namely, a personal flotation device adapted to be worn in stored condition by an individual.

FIG. 13 is a rear perspective view of the embodiment of the invention shown in FIG. 12.

FIG. 14 is a vertical section of the embodiment of the invention shown in FIG. 12.

FIG. 15 illustrates how the device of FIG. 12 is worn by an inventor.

FIG. 16 illustrates the device of FIG. 12 in the process of being actuated.

FIG. 17 shows the individual with the fully deployed personal flotation device.

FIG. 18 is a schematic diagram illustrating the method of inflation.

SPECIFIC EXAMPLES OF INVENTION

Figure 1:
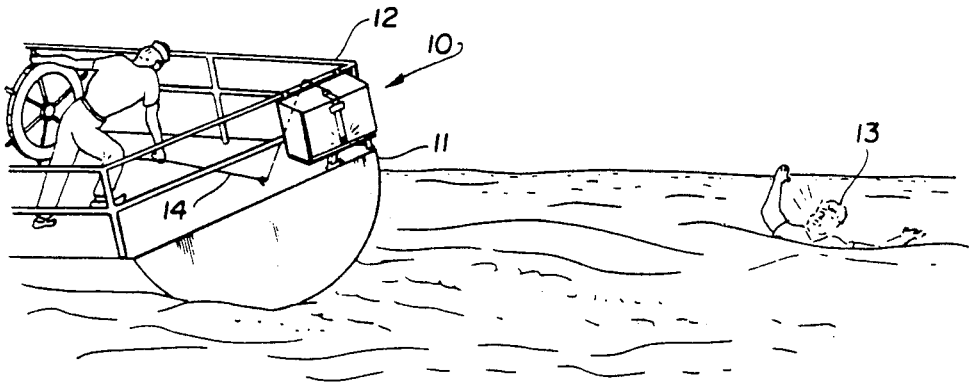

Referring now to FIGS. 1–11 in the drawings, a preferred embodiment 10 of this invention is shown attached to the rail 12 of vessel 11 with straps 97 and 98. The container 100 comprises a back wall 100*a* vertically attached to two side walls 100*b*. A top wall 100*c* has a foldable, flexible front extension 100*d*. Extending from the bottom of back wall 100*a* is a bottom panel 102 attached only along one edge and having a foldable skirt extension 103*a* provided with a fastener means 102*b* as for example, the fastener sold under the trademark "Velcro". Front flexible panel 100*d* has cooperating fastening means 100*dd*. Panel 100*d* also has an external metal snap 102*a* to which is attached strap 100*f* extending through loop 109 to ring 101 attached to release line 14 which in turn is held on the deck 96 of the vessel. Pulling on the release line 14 causes the flexible front panel 100*d* to be separated from the skirt 103*a* and pulled up. The skirt with the bottom panel 102 drops back and down and the contents of the container drop down to the water in a very rapid fashion.

Stored within the container is a collapsed, inflatable horseshoe flotation device 111, a collapsed, inflatable signal cone 104, a weight 105 in the signal cone, carbon dioxide storage means 301 and carbon dioxide valve release means 300 associated with said carbon dioxide storage means. The signal cone and horseshoe flotation device are tethered together with lines 109 and 110.

Also stored in the container are other rescue devices such as an air horn, whistle, dye marker, aerial flare, mini strobe light, signal light and personal light. Assocaited with the inflatable cone is a signal flag 108, a wter-activated light 120, reflective panels 121 and a drogue 119. The container is preferably made with a vacuum-formed plastic inner liner covered with nylon pack cloth.

Figure 2:
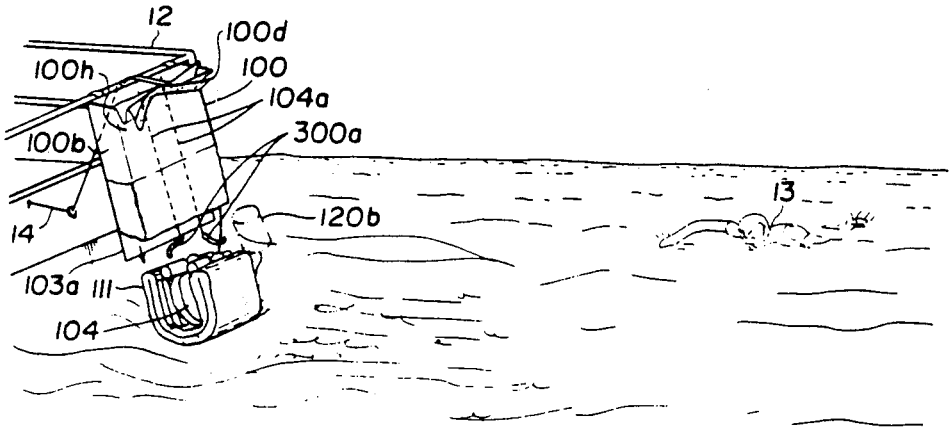
Figure 3:
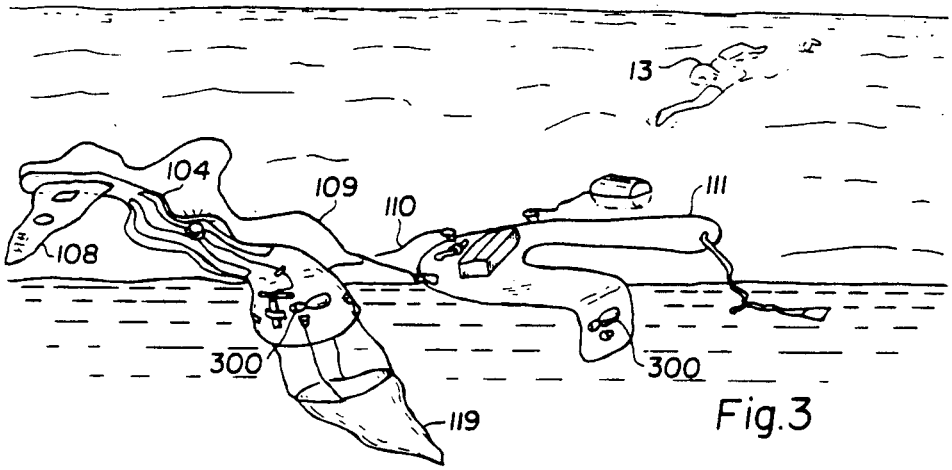
Figure 4:
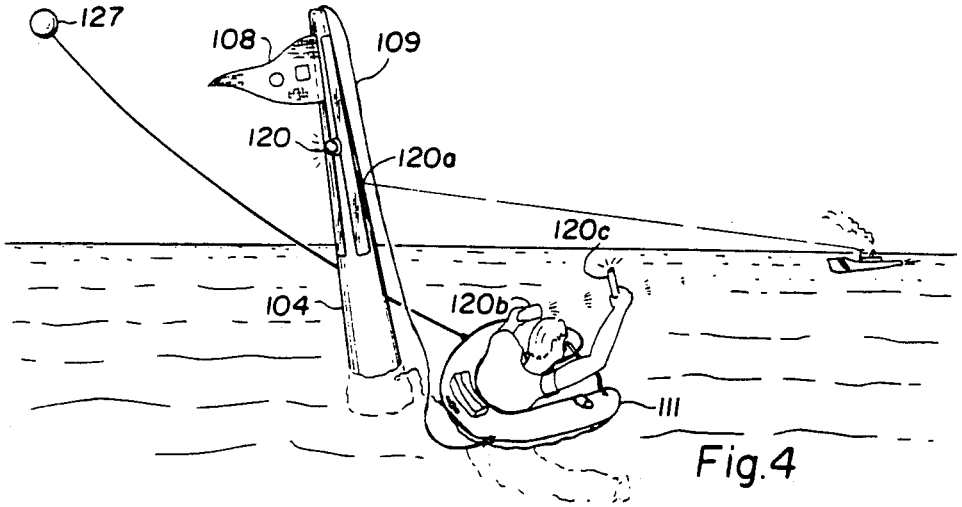
Figure 5:
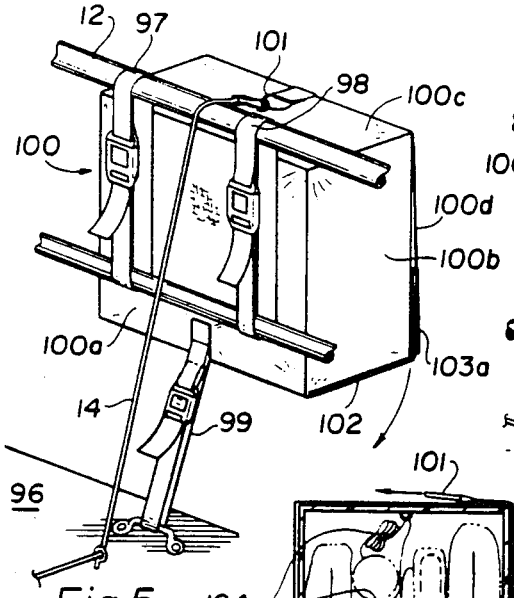
Figure 6:
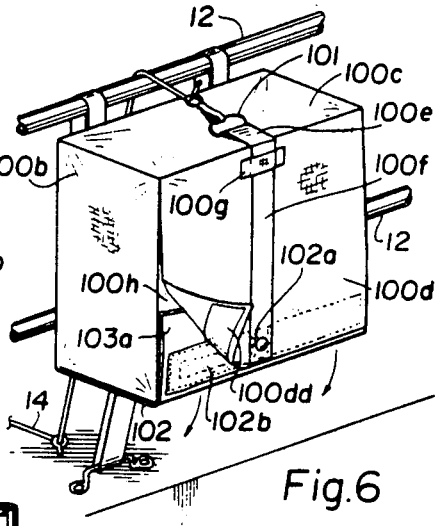
Figure 7:
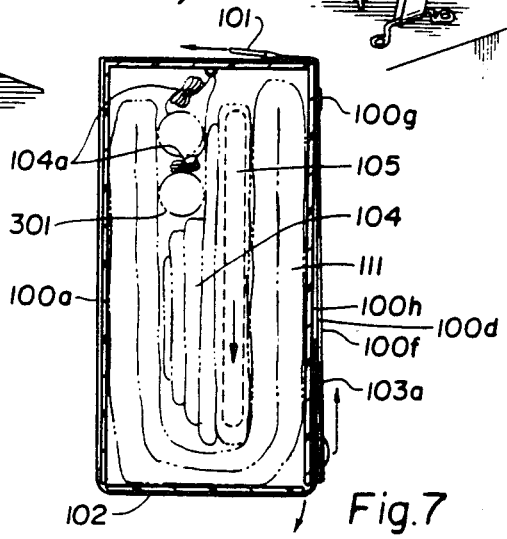
Figures 8, 9:
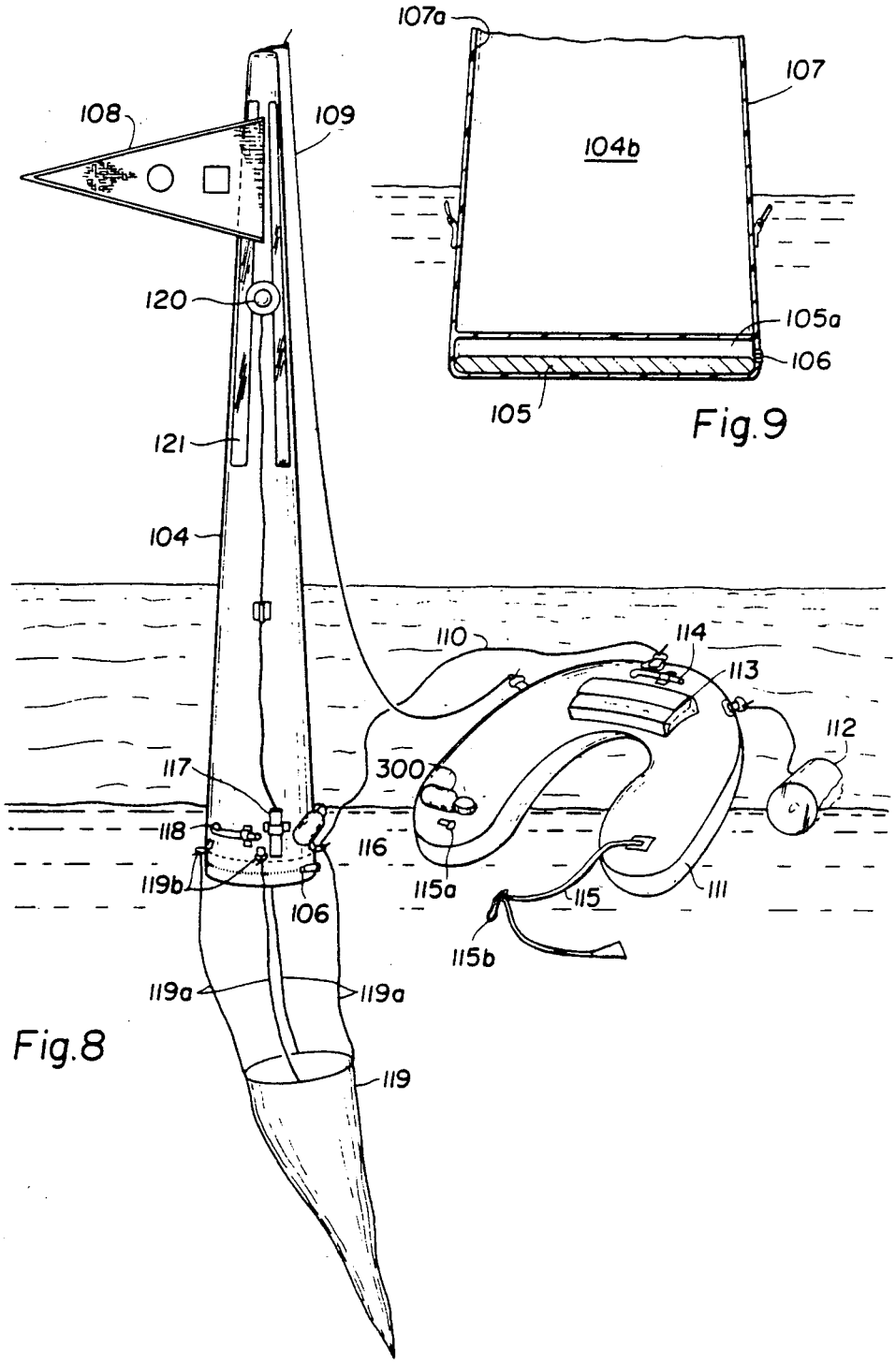
Figure 11:
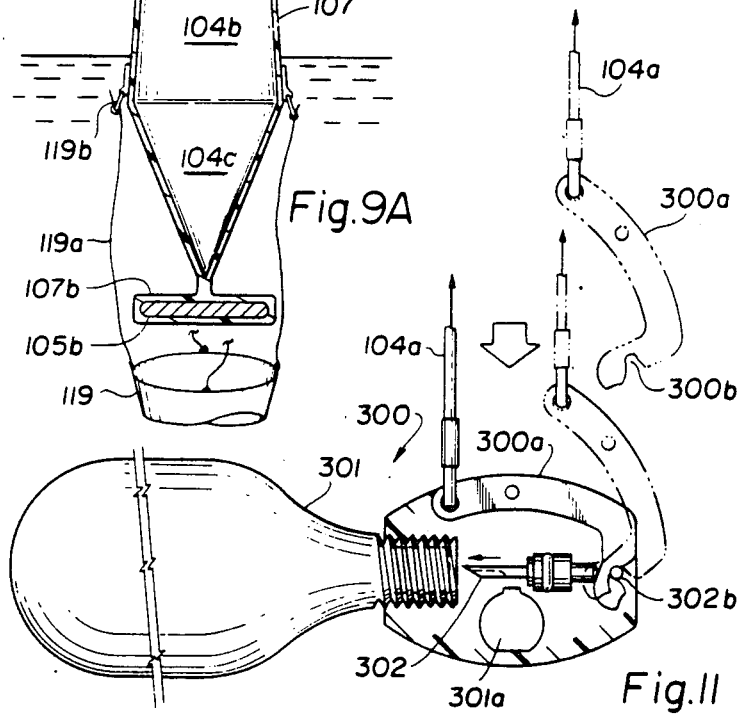
Figure 12:
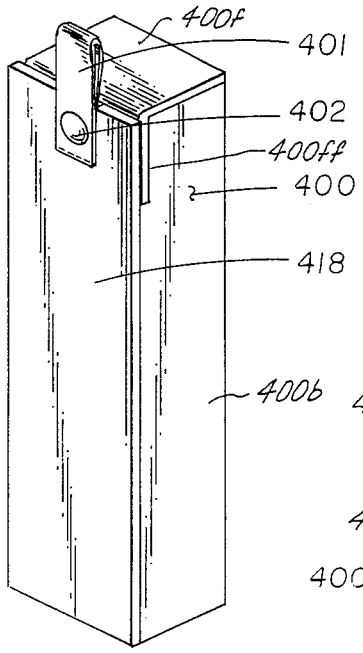
FIGS. 12–18 illustrate a container worn by an individual person.
Figure 13:
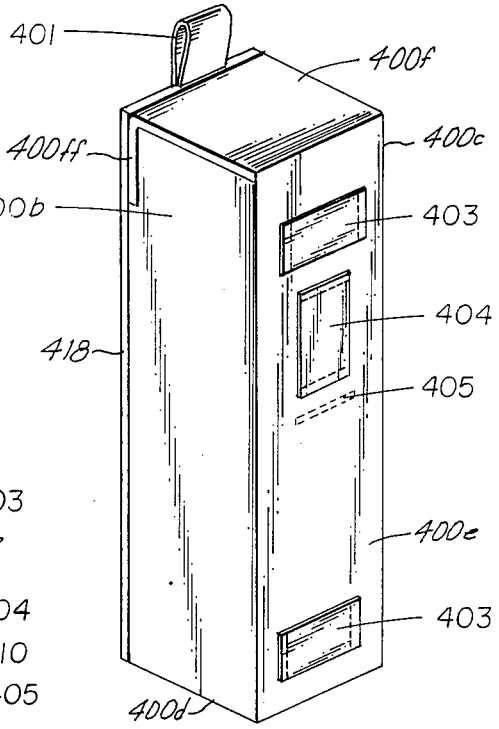
Figure 14:
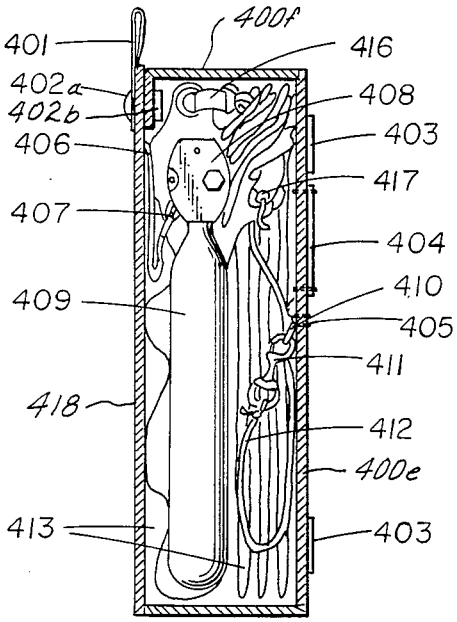
Figure 15:
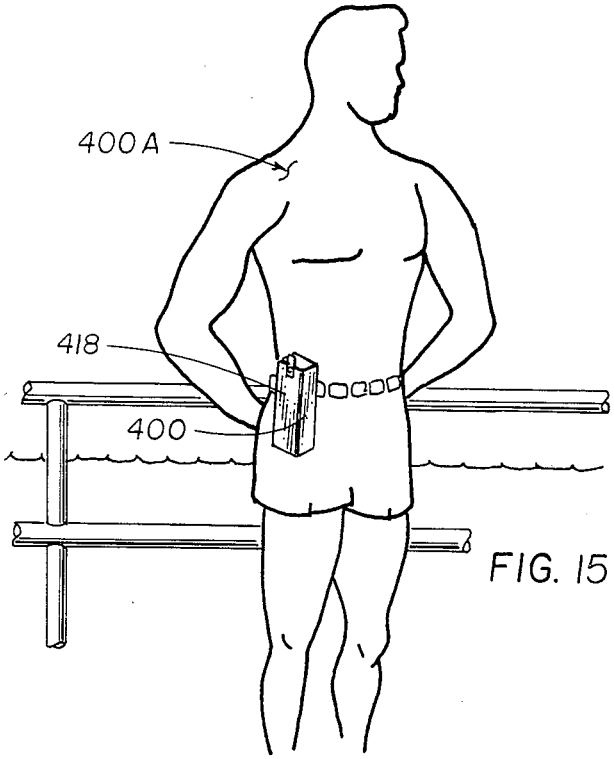
Figure 17:
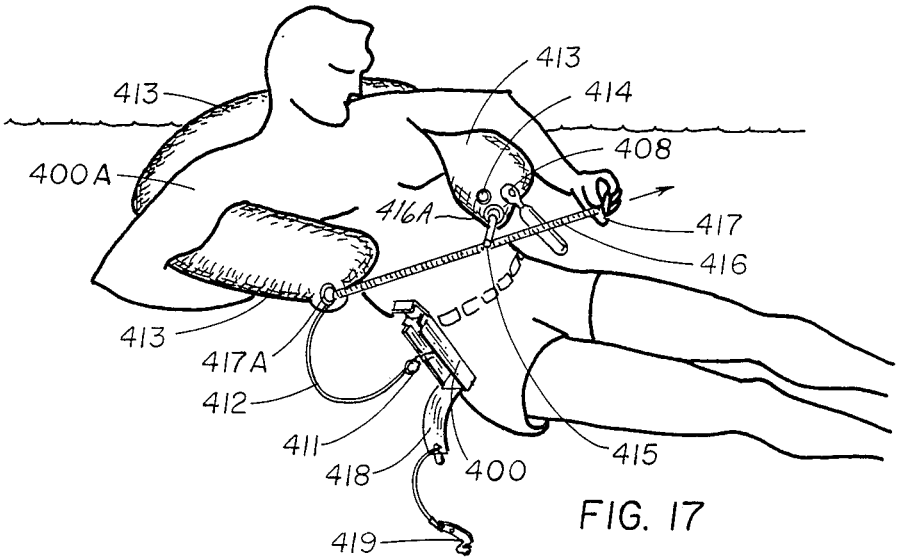
Figure 16:
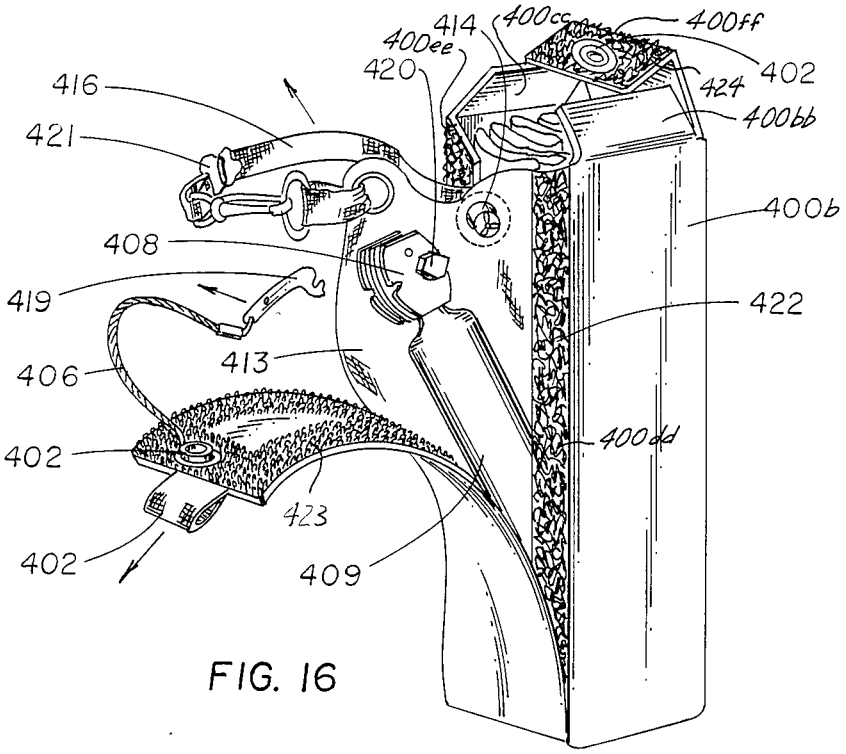
Figure 18:
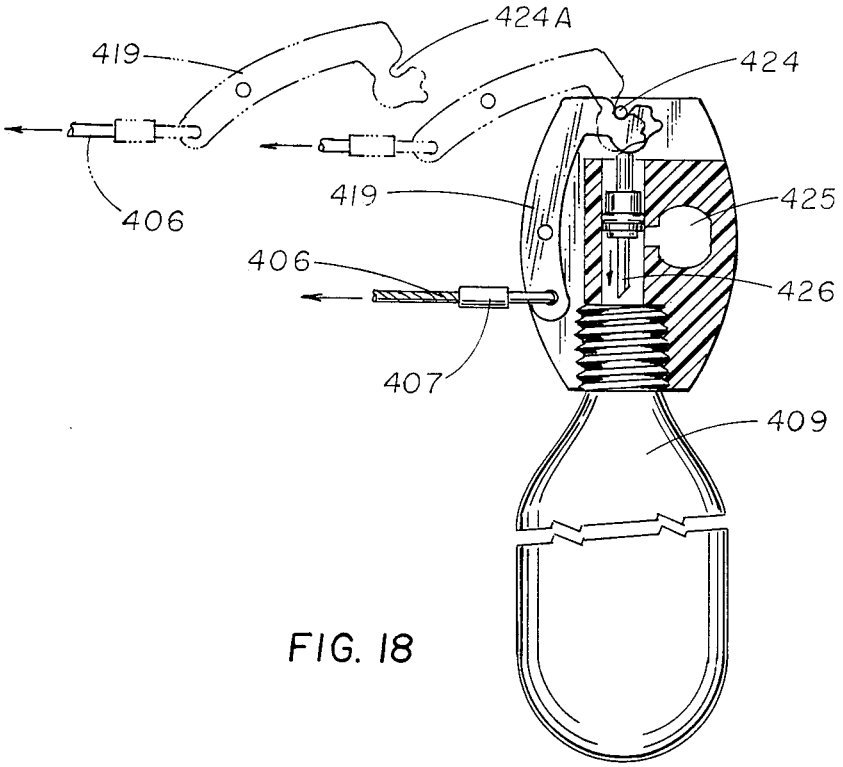

When the release line 14 is pulled the contents of the container 100 immediately fall out and the inflatable cone and horseshoe flotation device are automatically inflated as illustrated more particularly in FIGS. 2 and 11. Lanyards 104*a* are attached to cam-shaped levers 300*a* having cut-out 300*b* which mount on pivot 302*b*. When the contents are dropped out of the container, the cam-shaped levers 300*a* rotate so as to drive puncture pin 302 into the carbon dioxide reservoir 301 and then separate from the pivot 302*b*. Inflation thus begins while the cone and horseshoe device are still falling.

Figure 10:
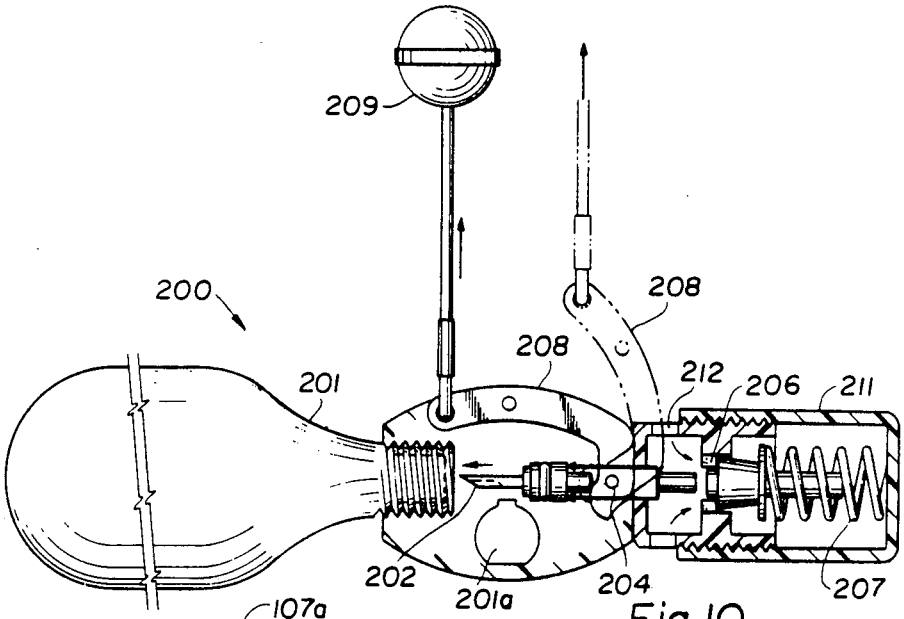

An alternative method of automatic inflation is to use as illustrated in FIG. 10, a water-soluble release which permits spring 207 to drive puncture pin 202 into carbon dioxide container 201, utilizing a fixed cam lever 203. Both devices have, as a safety, a manual activator 209 in the event that the automatic inflation fails.

Signal cone 104 when inflated, sits vertically in the water. Its weight compartment 105*a* has a zipper 106 for insertion of weight 105 and is separated from the carbon dioxide compartment. The cone 104 is preferably neoprene-coated nylon 107 with aluminized mylar coating 107*a* for radar reflection. It has connections 119*b* for lines 119*a* holding stabilizing sea anchor 119. A light 120 is mounted in the upper end and makes the reflective panels 121 visible. Power for the light 120 is provided by a water-activated battery 117. Signal flag 108 is mounted near the top of the cone. A manual inflation tube 118 is provided.

The horeshoe flotation device also has a manual inflation tube 114, a pocket 113 for ancillary devices, and a line 115 which connects the snap 115*b* to snap 115*a* to hold the survivor 13 within the flotation device. Among the ancillary devices are a helium balloon 127, a strobe light 120*b* and a flare 120*c*.

Figure 9A:
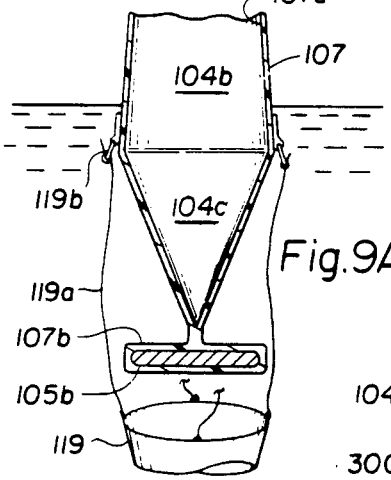
FIG. 9A is a partial section showing an alternate construction of the signal cone.

An alternative structure for anchoring the signal cone, as illustrated in FIG. 9A, is to form the bottom of the inflation chamber 104*a* as an inverted cone 107*b* terminating in chamber 107*b* containing a lead weight 205*b*.

Referring now to the embodiment of the invention illustrated in FIGS. 12 to 18, a personal flotation device 400 is shown attached to the belt on clothing of a man 400A. The device has an outer case comprising side walls 400*b* and 400*c*, bottom wall 400*d*, rear wall 400*e*, top wall 400*f*. The side walls, bottom wall and back wall are firmly attached to one another. However, the front flap 418 is permanently attached only at its bottom. In stored condition, the front flap 418 is detachably connected by snap 402*a* to snap 402*b* which is in a depending portion 400*ff* of the top wall 400*f*. Top wall 400*f* is permanently attached at its bottom to the top of rear wall 400*e* so that it also is a flap. Side walls 400*b* and 400*c* have top extensions 400*bb* and 400*cc* and front foldable extensions 400*dd* and 400*ee*. Accordingly when snap 402*a* is engaged with snap 402*b* flap 418 fits against extensions 400*dd* and 400*ee* and top flap 400*f* covers side wall extension 400*bb* and 400*cc*. There are preferably fastener means that are readily detachable as for example, hook and loop fabric means such as the fastener sold under the trademark "Velcro" 422, 423 and 424 on the outer surfaces of the extensions to permit a smooth disengagement when the front is opened by the individual pulling pull tab 401. The rear wall 400*e* of the container has stitched loops 403 and 404 for attachment to belts or other suitable parts of clothing.

Stored within the container is an inflatable horseshoe-shaped flotation device 413. Flotation device 413 is attached by lanyard 412 which, in turn, is connected by snap hook 411 to metal ring 410 which, in turn, is attached to the back wall 400*e* of the container by stitching 405. It can be thus seen that, at all times the flotation device is connected to the container 400 which, in turn, is attached to the person 400*a*.

Attached to the front pull flap 418 is an operating lanyard 406 which, with clasp 407, is attached to one end of cam crank 419. When the tab 401 is pulled, it causes the cam-shaped lever 419 to rotate by its cut-out portion 424A on pin 424 so as to drive puncture pin 426 into the carbon dioxide reservoir 409 and then separate from pin 424. The carbon dioxide gas enters through valve opening 425 and valve 420 and quickly inflates the horseshoe shaped flotation device 413. A mouth piece 414 is provided as a safety device for re-inflating the flotation device.

The flotation device 413 is provided with a nylon belt 416 having an adjustable buckle 416A, a belt handle 417, an eyelet 417A and a length-adjusting buckle 421. Thus, when the man equipped with the flotation device jumps into the water he can, either before or after he hits the water, actuate the device by pulling on the front flap 418 and be certain that, at all times, the inflated flotation device will be attached to him and readily adjustable for safety and comfort.

An alternate method of automatic inflation is to use a water-soluble release. The release holds back a spring which, when released, drives the puncture pin 426 into the carbon dioxide reservoir 409. This could be of similar construction as shown in FIG. 10, including the manual activator 209.

I claim:

1. An emergency rescue assembly for rescuing a person in a body of water, comprising in combination:

a container including left and right side walls, top and bottom walls, and front and rear walls, said side, bottom and rear walls being secured together to form an open-ended enclosure, said front wall being secured along one edge to said bottom wall to form a front flap, said top wall being secured along one edge to said rear wall to form a top flap;

means for removably fastening said front wall to said side walls and to said top wall whereby said front wall may be secured in a closed position fastened to said side walls and to said top wall to close the open-ended enclosure and whereby said front wall may be pulled open to an opened position allowing access to said container;

an inflatable personal flotation device stored within said container;

means for inflating said personal flotation device upon pulling said front wall to said opened position, said inflating means including storage means containing a supply of compressed gas, valve release means associated with said storage means and including a puncture pin operatively disposed within a body for piercing said storage means allowing the gas contained therein to flow into said personal flotation device, said valve release means further including a removable cam-shaped lever having a cut-out mounted on a pivot pin and a lanyard having one end connected to said cam-shaped lever for pivoting said cam-shaped lever about said pivot pin to drive said puncture pin into said storage means whereupon said cam-shaped lever is disengaged from said body, means for connecting another end of said lanyard relative to said front wall functioning as said front flap, whereby said valve is automatically actuated to begin inflation of said personal flotation device upon pulling of said front flap; and tether means securely interconnecting said container and said personal flotation device.

2. The emergency rescue assembly as set forth in claim 1, wherein said removable fastening means comprises a hook and loop fabric means which are complementarily secured along the side and top edge of said front wall and the respective mating edges of said side walls and said top wall whereby said front wall is removably secured in said closed position to said side walls and to said top wall to fully close said open-ended enclosure.

3. The emergency rescue assembly as set forth in claim 2, wherein said side walls each include an extension along the length of their edge, wherein said top wall further includes an extension along its front edge, and wherein the respective said hook and loop fastener means is affixed to said extensions, whereby said front flap is more securely removably fastened to said extensions of said side walls and of said top wall when said front flap is in said closed position.

4. The emergency rescue assembly as set forth in claim 3, further including releasable two component snap means having one component affixed to said extension of said top wall and the other component affixed to the uppermost edge of said front flap, whereby said snap means must be unfastened prior to the unfastening of said hook and loop fastener means.

* * * * *